US011830663B2

(12) United States Patent
Kang et al.

(10) Patent No.: US 11,830,663 B2
(45) Date of Patent: Nov. 28, 2023

(54) COIL COMPONENT

(71) Applicant: SAMSUNG ELECTRO-MECHANICS CO., LTD., Suwon-si (KR)

(72) Inventors: Byung Soo Kang, Suwon-si (KR); Byeong Cheol Moon, Suwon-si (KR); Ju Hwan Yang, Suwon-si (KR); Yoon Mi Cha, Suwon-si (KR); Tai Yon Cho, Suwon-si (KR); Tae Jun Choi, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 408 days.

(21) Appl. No.: 16/989,091

(22) Filed: Aug. 10, 2020

(65) Prior Publication Data

US 2021/0350976 A1 Nov. 11, 2021

(30) Foreign Application Priority Data

May 8, 2020 (KR) ..... 10-2020-0054838

(51) Int. Cl.
*H01F 5/00* (2006.01)
*H01F 27/29* (2006.01)
(Continued)

(52) U.S. Cl.
CPC ..... *H01F 27/29* (2013.01); *H01F 27/255* (2013.01); *H01F 27/32* (2013.01); *H01F 41/12* (2013.01)

(58) Field of Classification Search
CPC ..... H01F 27/29
(Continued)

(56) References Cited

U.S. PATENT DOCUMENTS 9,704,640 B2 7/2017 Choi et al.
2012/0274429 A1* 11/2012 Ogawa ..... H01F 1/26 335/299
(Continued)

FOREIGN PATENT DOCUMENTS

KR 10-2015-0044372 A 4/2015
KR 10-2015-0114924 A 10/2015
(Continued)

OTHER PUBLICATIONS

Office Action issued in corresponding Korean Patent Application No. 10-2020-0054838 dated Aug. 2, 2021, with English translation.
(Continued)

*Primary Examiner* — Ronald Hinson
(74) *Attorney, Agent, or Firm* — Morgan, Lewis & Bockius LLP

(57) ABSTRACT

A coil component includes a body having one surface and the other surface, opposing each other, and wall surfaces, and including a metal magnetic powder particle and an insulating resin; a coil portion disposed in the body and including first and second lead-out portions exposed from the one surface of the body to be spaced apart from each other; first and second external electrodes arranged on the one surface of the body to be spaced apart from each other and respectively connected to the first and second lead-out portions; a cover insulating layer covering the other surface of the body and extending to at least portion of each of the wall surfaces of the body; and an oxide insulating film disposed on a surface of the metal magnetic powder particle exposed from the one surface of the body and including metal ions of the metal magnetic powder particle.

12 Claims, 11 Drawing Sheets

(51) Int. Cl.
*H01F 41/12* (2006.01)
*H01F 27/32* (2006.01)
*H01F 27/255* (2006.01)

(58) Field of Classification Search
USPC ..... 336/200
See application file for complete search history.

(56) References Cited

U.S. PATENT DOCUMENTS

2012/0274432 A1* 11/2012 Jeong ..... H01F 27/2804 336/192
2013/0298730 A1* 11/2013 Ikeda ..... B22F 3/24 419/10
2015/0102891 A1 4/2015 Yoon et al.
2016/0035476 A1* 2/2016 Mimura ..... H01F 41/046 336/199
2016/0086714 A1* 3/2016 Moon ..... H01F 27/255 336/200
2016/0086716 A1* 3/2016 Choi ..... H01F 17/0013 427/127
2016/0086717 A1* 3/2016 Harada ..... C22F 1/10 148/303
2020/0168391 A1 5/2020 Yang et al.

FOREIGN PATENT DOCUMENTS

KR 10-2016-0033463 A 3/2016
KR 10-2016-0040422 A 4/2016
KR 10-2019-0062342 A 9/2019
KR 10-2093147 B1 3/2020

OTHER PUBLICATIONS

Korean Office Action dated May 2, 2023, issued in corresponding Korean Patent Application No. 10-2022-0070735.

* cited by examiner

D

COIL COMPONENT

CROSS-REFERENCE TO RELATED APPLICATION(S)

This application claims benefit of priority to Korean Patent Application No. 10-2020-0054838 filed on May 8, 2020 in the Korean Intellectual Property Office, the disclosure of which is incorporated herein by reference in its entirety.

TECHNICAL FIELD

The present disclosure relates to a coil component.

BACKGROUND

An inductor, a coil component, is a typical passive electronic component used in electronic devices, along with a resistor and a capacitor.

As electronic devices gradually become high-performance and smaller, the number of electronic components used therein may increase, and the electronic components may be miniaturized.

In the case of a thin film type component, a magnetic composite sheet in which metal magnetic powder particles are dispersed in an insulating resin on a substrate on which a coil portion is formed by plating, may be stacked and cured to form a body, and external electrodes may be formed on a surface of the body.

SUMMARY

An aspect of the present disclosure is to provide a coil component capable of easily forming an insulating structure on a surface of a body.

An aspect of the present disclosure is to provide a coil component capable of easily forming a lower electrode structure.

An aspect of the present disclosure is to provide a coil component capable of decreasing a weight and a size.

An aspect of the present disclosure is to provide a coil component capable of preventing electrical short circuits between external electrodes.

According to an aspect of the present disclosure, a coil component includes a body having one surface and the other surface, opposing each other, and a plurality of wall surfaces respectively connecting the one surface and the other surface, and including a metal magnetic powder particle and an insulating resin; a coil portion disposed in the body and including first and second lead-out portions exposed from the one surface of the body to be spaced apart from each other; first and second external electrodes arranged on the one surface of the body to be spaced apart from each other and respectively connected to the first and second lead-out portions; a cover insulating layer covering the other surface of the body and extending to at least portion of each of the plurality of wall surfaces of the body; and an oxide insulating film formed on a surface of the metal magnetic powder particle exposed from the one surface of the body and including metal ions of the metal magnetic powder particle.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
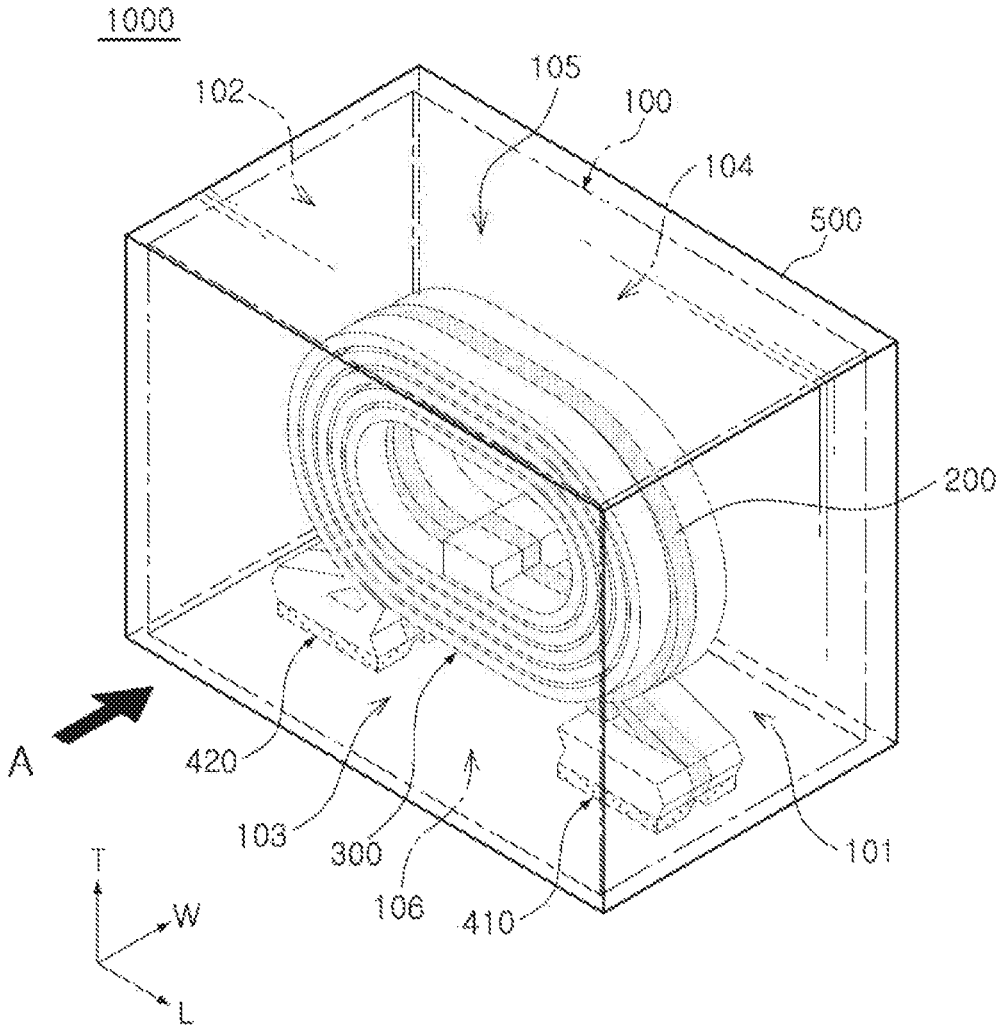
FIG. 1 is a view schematically illustrating a coil component according to a first embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction may be defined as a first direction or a length (longitudinal) direction, a W direction may be defined as a second direction or a width direction, a T direction may be defined as a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
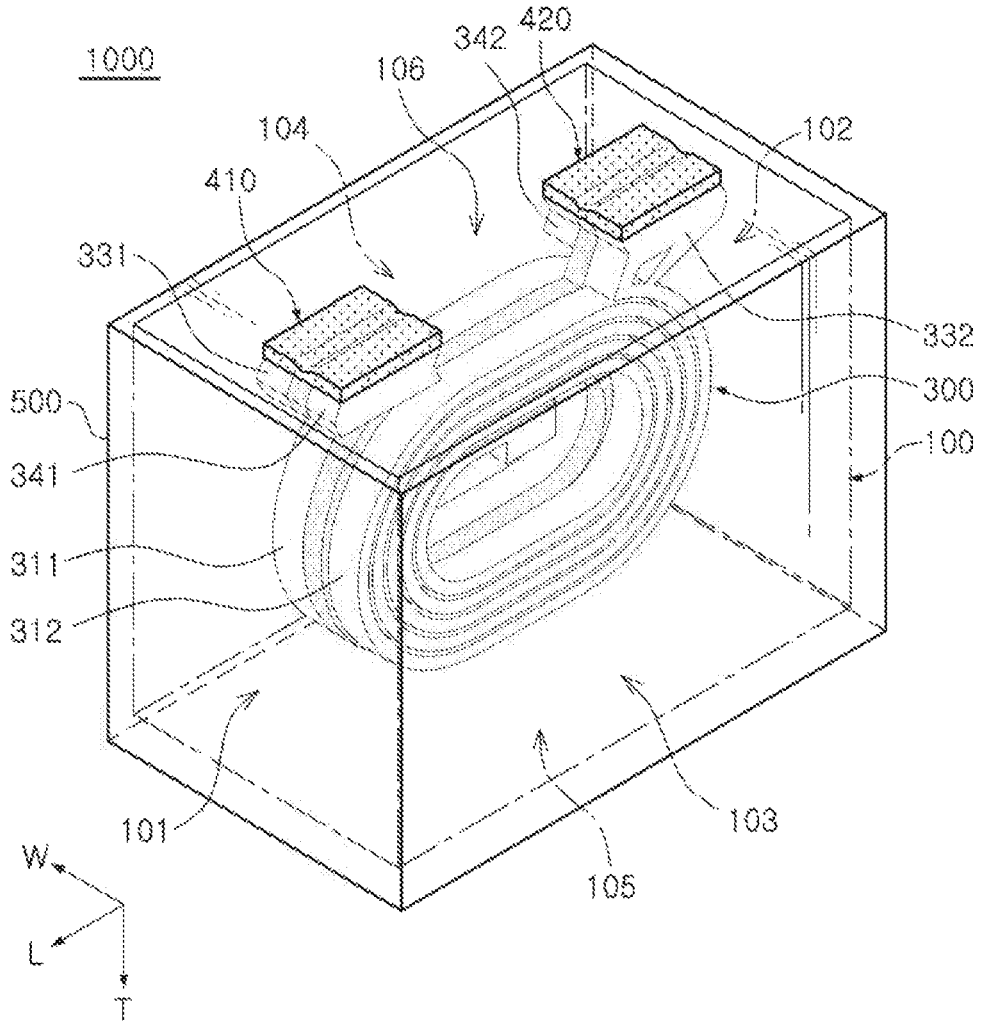
FIG. 2 is a view schematically illustrating a coil component according to a first embodiment of the present disclosure, when viewed from below.
Figure 3:
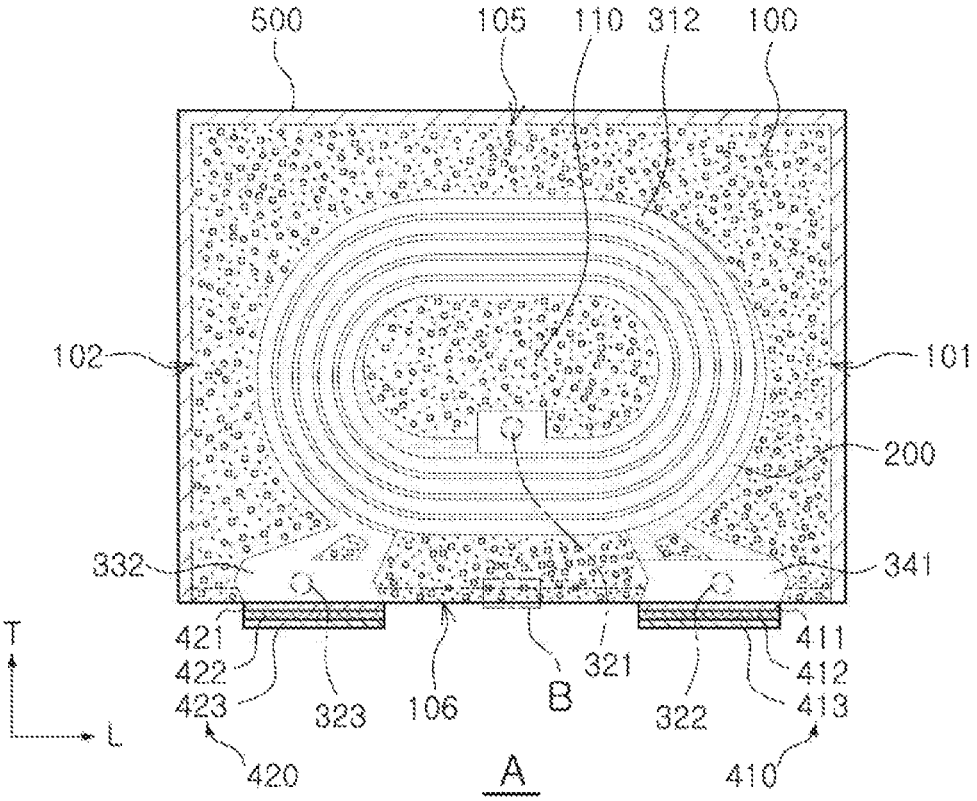
FIG. 3 is a schematic view of FIG. 1, when viewed in direction A.
Figure 4:
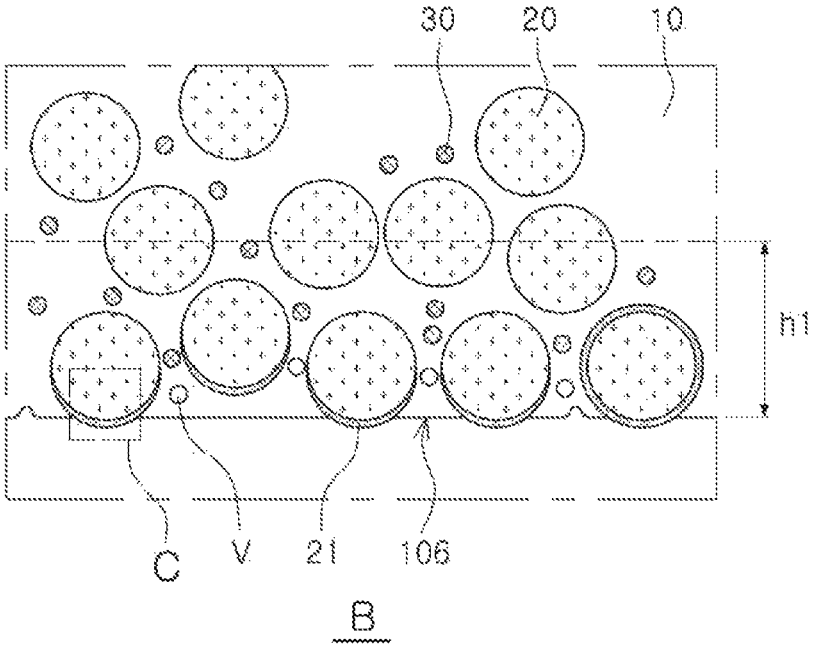
FIG. 4 is an enlarged view of portion B of FIG. 3.
Figure 5:
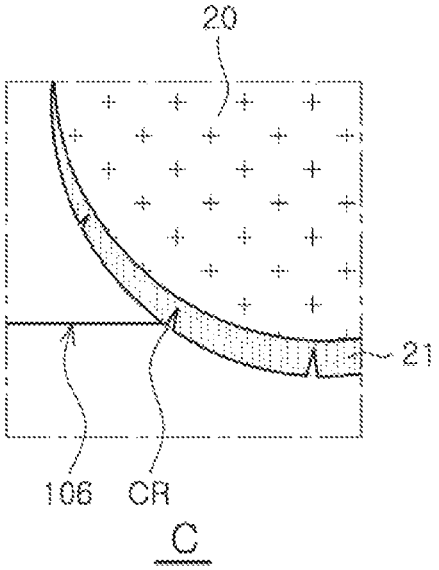
FIG. 5 is an enlarged view of portion C of FIG. 4.

FIG. 1 is a view schematically illustrating a coil component according to a first embodiment of the present disclosure. FIG. 2 is a view schematically illustrating a coil component according to a first embodiment of the present disclosure, when viewed from below. FIG. 3 is a schematic view of FIG. 1, when viewed in direction A. FIG. 4 is an enlarged view of portion B of FIG. 3. FIG. 5 is an enlarged view of portion C of FIG. 4. FIG. 3 illustrates FIG. 1 when viewed in direction A, but illustrates an internal structure of a coil component according to a first embodiment of the present disclosure.

Referring to FIGS. 1 to 5, a coil portion 1000 according to an embodiment of the present disclosure may include a body 100, a support substrate 200, a coil portion 300, external electrodes 410 and 420, a cover insulating layer 500, and an oxide insulating film 21.

The body 100 may form an exterior of the coil component 1000 according to this embodiment, and the coil portion 300 may be embedded therein.

The body 100 may be formed to have a hexahedral shape overall.

Referring to FIGS. 1 to 3, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body 100, and both side surfaces of the body 100 may refer to the third surface 103 and the fourth surface 104 of the body 100. In addition, one surface and the other surface of the body 100 may refer to the sixth surface 106 and the fifth surface 105 of the body 100, respectively.

The body 100 may, for example, be formed such that the coil component 1000 according to this embodiment in which the external electrodes 410 and 420, the cover insulating layer 500, and the oxide insulating film 21, to be described later, are formed has a length of 1.0 mm, a width of 0.5 mm, and a thickness of 0.8 mm, but is not limited thereto. Since the above-described numerical values are only design values that do not reflect process errors and the like, it should be considered that they fall within the scope of the present disclosure, to the extent that they are recognized as process errors.

Based on an image for a cross-section of a central portion of the body 100 in the width direction W, in the longitudinal direction L-thickness direction T, captured by an optical microscope or a scanning electron microscope (SEM), the length of the coil component 1000 described above may refer to a maximum value among lengths of a plurality of line segments, connecting outermost boundary lines of the coil component 1000, and parallel to the longitudinal direction L of the body 100, as shown in the captured image. Alternatively, based on an image for a cross-section of a central portion of the body 100 in the width direction W, in the longitudinal direction L-thickness direction T, captured by an optical microscope or a scanning electron microscope (SEM), the length of the coil component 1000 described above may refer to a minimum value among lengths of a plurality of line segments, connecting outermost boundary lines of the coil component 1000, and parallel to the longitudinal direction L of the body 100, as shown in the captured image. Alternatively, based on an image for a cross-section of a central portion of the body 100 in the width direction W, in the longitudinal direction L-thickness direction T, captured by an optical microscope or a scanning electron microscope (SEM), the length of the coil component 1000 described above may refer to an arithmetic mean value of at least three or more lengths of a plurality of line segments, connecting outermost boundary lines of the coil component 1000, and parallel to the longitudinal direction L of the body 100, as shown in the captured image.

Based on an image for a cross-section of a central portion of the body 100 in the width direction W, in the longitudinal direction L-thickness direction T, captured by an optical microscope or a scanning electron microscope (SEM), the thickness of the coil component 1000 described above may refer to a maximum value among lengths of a plurality of line segments, connecting outermost boundary lines of the coil component 1000, and parallel to the thickness direction T of the body 100, as shown in the captured image. Alternatively, based on an image for a cross-section of a central portion of the body 100 in the width direction W, in the longitudinal direction L-thickness direction T, captured by an optical microscope or a scanning electron microscope (SEM), the thickness of the coil component 1000 described above may refer to a minimum value among lengths of a plurality of line segments, connecting outermost boundary lines of the coil component 1000, and parallel to the thickness direction T of the body 100, as shown in the captured image. Alternatively, based on an image for a cross-section of a central portion of the body 100 in the width direction W, in the longitudinal direction L-thickness direction T, captured by an optical microscope or a scanning electron microscope (SEM), the thickness of the coil component 1000 described above may refer to an arithmetic mean value of at least three or more lengths of a plurality of line segments, connecting outermost boundary lines of the coil component 1000, and parallel to the thickness direction T of the body 100, as shown in the captured image.

Based on an image for a cross-section of a central portion of the body 100 in the thickness direction T, in the longitudinal direction L-width direction W, captured by an optical microscope or a scanning electron microscope (SEM), the width of the coil component 1000 described above may refer to a maximum value among lengths of a plurality of line segments, connecting outermost boundary lines of the coil component 1000, and parallel to the width direction W of the body 100, as shown in the captured image. Alternatively, based on an image for a cross-section of a central portion of the body 100 in the thickness direction T, in the longitudinal direction L-width direction W, captured by an optical microscope or a scanning electron microscope (SEM), the width of the coil component 1000 described above may refer to a minimum value among lengths of a plurality of line segments, connecting outermost boundary lines of the coil component 1000, and parallel to the width direction W of the body 100, as shown in the captured image. Alternatively, based on an image for a cross-section of a central portion of the body 100 in the thickness direction T, in the longitudinal direction L-width direction W, captured by an optical microscope or a scanning electron microscope (SEM), the width of the coil component 1000 described above may refer to an arithmetic mean value of at least three or more lengths of a plurality of line segments, connecting outermost boundary lines of the coil component 1000, and parallel to the width direction W of the body 100, as shown in the captured image.

Alternatively, the length, the width, and the thickness of the coil components 1000 described above may be measured by a micrometer measurement method, respectively. The micrometer measurement method may be carried out by setting a zero point with a micrometer (apparatus) having a Gage R&R technique (i.e., a gage repeatability and reproducibility technique), inserting the coil component 1000 between tips of the micrometer, and turning a measuring lever of the micrometer. In measuring the length of the coil component 1000 by the micrometer measurement method, the length of the coil component 1000 may refer to a value measured once, or may refer to an arithmetic mean of values measured multiple times. This may be equally applied to the width and the thickness of the coil component 1000.

The body 100 may include metal magnetic powder particles 20 and 30, and an insulating resin 10. Specifically, the body 100 may be formed by stacking one or more magnetic composite sheets including an insulating resin 10 and metal magnetic powder particles 20 and 30 dispersed in the insulating resin 10.

The metal magnetic powder particles 20 and 30 may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particles 20 and 30 may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particles 20 and 30 may be amorphous or crystalline. For example, the metal magnetic powder particles 20 and 30 may be a Fe—Si—B—Cr-based amorphous alloy powder particle, but are not limited thereto. Each of the metal magnetic powder particles 20 and 30 may have an average diameter of about 0.1 μm to 30 μm, but are not limited thereto.

The metal magnetic powder particles 20 and 30 may include a first powder particle 20, and a second powder particle 30 having a particle diameter, smaller than a particle diameter of the first powder particle 20. In the present specification, the particle diameter may refer to a particle diameter distribution represented by $D_{90}$, $D_{50}$, or the like. In the case of the present disclosure, the metal magnetic powder particles 20 and 30 may include the first powder particle 20 and the second powder particle 30 having a smaller particle diameter than the first powder particle 20, such that the second powder particle 30 may be placed in a space between the first powder particles 20. Therefore, a ratio of filling a magnetic body in the resulting body 100 may be improved. Hereinafter, for convenience of explanation, it will be described that the metal magnetic powder particles 20 and 30 of the body 100 are composed of the first powder particle 20 and the second powder particle 30 having different particle diameters for the purposes of explanation, but the scope of the present disclosure is not limited thereto. For example, as another non-limiting example of the present disclosure, the metal magnetic powder particle may include three types of powder particles having different particle diameters. An insulating coating layer may be formed on surfaces of the metal magnetic powder particles 20 and 30, but is not limited thereto.

The insulating resin 10 may include an epoxy, a polyimide, a liquid crystal polymer, or the like, in a single form or in combined form, but is not limited thereto.

The body 100 may include a core 110 passing through the support substrate 200 and the coil portion 300, to be described later. The core 110 may be formed by filling a through-hole of the coil portion 300 with a magnetic composite sheet, but is not limited thereto.

The support substrate 200 may be disposed in the body 100. The support substrate 200 may be configured to support the coil portion 300, which will be described later.

The support substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate 200 may be formed of a material such as prepreg, Ajinomoto Build-up Film (ABF), FR-4, a Bismaleimide Triazine (BT) resin, a photoimageable dielectric (PID), a copper clad laminate (CCL), and the like, but are not limited thereto.

As the inorganic filler, at least one or more selected from a group consisting of silica ($SiO_2$), alumina ($A1_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide better rigidity. When the support substrate 200 is formed of an insulating material not containing glass fibers, the support substrate 200 may be advantageous for reducing a thickness of the overall coil portion 300 to reduce a width of a component. When the support substrate 200 is formed of an insulating material containing a photosensitive insulating resin, the number of processes for forming the coil portion 300 may be reduced. Therefore, it may be advantageous in reducing production costs, and a fine via may be formed.

The coil portion 300 may be disposed on the support substrate 200. The coil portion 300 may be embedded in the body 100 to express characteristics of the coil component. For example, when the coil component 1000 of this embodiment is used as a power inductor, the coil portion 300 may function to stabilize the power supply of an electronic device by storing an electric field as a magnetic field and maintaining an output voltage.

The coil portion 300 may be formed on at least one of both surfaces of the support substrate 200 opposing each other, and may form at least one turn. The coil portion 300 may be disposed on one surface and the other surface of the support substrate 200, opposing each other, in the width direction W of the body 100. Specifically, in this embodiment, the coil portion 300 may include coil patterns 311 and 312, vias 321, 322, and 323, and a lead-out portion.

Each of the first coil pattern 311 and the second coil pattern 312 may be in the form of a planar spiral shape having at least one turn formed about the core 110 of the body 100. For example, based on the direction of FIG. 1, the first coil pattern 311 may form at least one turn about the core 110 on a rear surface of the support substrate 200. The second coil pattern 312 may form at least one turn about the core 110 on a front surface of the support substrate 200. Each of the first and second coil patterns 311 and 312 may be formed in an extended form in which an end portion of an outermost turn connected to lead-out patterns 331 and 332 extends to be closer to the sixth surface 106 of the body 100, compared to a central portion of the body 100 in the thickness direction T. As a result, the first and second coil patterns 311 and 322 may increase the number of turns of the entire coil portion 300, compared to a case in which an end portion of an outermost turn of a coil is formed only to a central portion of a body in a thickness direction.

The lead-out portion may include lead-out patterns 331 and 332 and auxiliary lead-out patterns 341 and 342. Specifically, based on the direction of FIG. 1, a first lead-out portion (i.e., 331 and 341) may include a first lead-out pattern 331 extending from the first coil pattern 311 on the rear surface of the support substrate 200 and exposed from the sixth surface 106 of the body 100, and a first auxiliary lead-out pattern 341 disposed on the front surface of the support substrate 200 to correspond to the first lead-out pattern 331 and spaced apart from the second coil pattern 312. Based on the direction of FIG. 1, a second lead-out portion (i.e., 332 and 342) may include a second lead-out pattern 332 extending from the second coil pattern 312 on the front surface of the support substrate 200 and exposed from the sixth surface 106 of the body 100, and a second auxiliary lead-out pattern 342 disposed on the rear surface of the support substrate 200 to correspond to the second lead-out pattern 332 and spaced apart from the first coil pattern 311. The first lead-out portion (i.e., 331 and 341) and the second lead-out portion (i.e., 332 and 342) may be exposed from the sixth surface of the body 100, to be spaced apart from each other, and may be in contact with and connected to the first and second external electrodes 410 and 420 to be described later, respectively. A through portion passing through the lead-out patterns 331 and 332 and the auxiliary lead-out patterns 341 and 342 may be formed in the lead-out patterns 331 and 332 and the auxiliary lead-out patterns 341 and 342. In this case, since at least a portion of the body 100 is disposed in the through portion, bonding force between the body 100 and the coil portion 300 (an anchoring effect) may be improved.

The above-described auxiliary lead-out patterns 341 and 342 may be omitted in this embodiment, when considering an electrical connection relationship between the coil portion 300 and the external electrodes 410 and 420 to be described later. Since the auxiliary lead-out patterns 341 and 342 may be connected to the lead-out patterns 331 and 332 respectively by the second and third vias 322 and 323 to be described later, connection reliability between the coil portion 300 and the external electrodes 410 and 420 may be improved. In addition, since the auxiliary lead-out patterns 341 and 342 may symmetrically form the external electrodes 410 and 420, appearance defects may be reduced.

A first via 321 may pass through the support substrate 200 to connect innermost turns of the first and second coil patterns 311 and 312. The second via 322 may pass through the support substrate 200 to connect the first lead-out pattern 331 and the first auxiliary lead-out pattern 341. The third via 323 may pass through the support substrate 200 to connect the second lead-out pattern 332 and the second auxiliary lead-out pattern 342.

By doing so, the coil portion 300 may function as a single coil connected as a whole.

At least one of the coil patterns 311 and 312, the vias 321, 322, and 323, the lead-out patterns 331 and 332, and the auxiliary lead-out patterns 341 and 342 may include at least one conductive layer.

For example, when the second coil pattern 312, the vias 321, 322, and 323, the second lead-out pattern 332, and the first auxiliary lead-out pattern 341 are formed on a front surface of the support substrate 200 (based on the directions of FIG. 1) by plating, each of the second coil pattern 312, the vias 321, 322, and 323, the second lead-out pattern 332, and the first auxiliary lead-out pattern 341 may have a seed layer and an electroplating layer, respectively. The seed layer may be formed by a vapor deposition method such as electroless plating, sputtering, or the like. Each of the seed layer and the electroplating layer may have a single-layer structure or a multilayer structure. The electroplating layer of the multilayer structure may be formed by a conformal film structure in which one electroplating layer is covered by the other electroplating layer, or may have a form in which the other electroplating layer is stacked on only one surface of the one electroplating layer. The seed layer of the second coil pattern 312, the seed layers of the vias 321, 322, and 323, and the seed layer of the second lead-out pattern 332 may be integrally formed, no boundary therebetween may occur, but are not limited thereto. The electrolytic plating layer of the second coil pattern 312, the electroplating layers of the vias 321, 322, and 323, and the electroplating layer of the second lead-out pattern 332 may be integrally formed, and thus, no boundary therebetween may occur, but the present disclosure is not limited thereto.

The coil patterns 311 and 312, the vias 321, 322, and 323, the lead-out patterns 331 and 332, and the auxiliary lead-out patterns 341 and 342, respectively, may be formed of a conductive material such as copper (Cu), aluminum (Al), silver (Ag), tin (Sn), gold (Au), nickel (Ni), lead (Pb), chromium (Cr), titanium (Ti), molybdenum (Mo), or alloys thereof, but are not limited thereto.

In this embodiment, since the coil portion 300 may be disposed to be perpendicular to the sixth surface 106 of the body 100 which may be the mounting surface, amounting area may be reduced while maintaining volumes of the body 100 and the coil portion 300. For this reason, a relatively large number of electronic components may be mounted on a mounting substrate having the same area. In addition, in this embodiment, since the coil portion 300 may be disposed to be perpendicular to the sixth surface 106 of the body 100, which may be the mounting surface, a direction of magnetic flux induced by the coil portion 300 may be disposed to be parallel to the sixth surface 106 of the body 100. Due to this, noise induced on the mounting surface of the mounting substrate may be relatively reduced.

The external electrodes 410 and 420 may be arranged on the sixth surface 106 of the body 100 to be spaced apart from each other, and may be connected to the lead-out portions (i.e., 331, 332, 341, and 342), respectively. Specifically, the first external electrode 410 may be disposed on the sixth surface 106 of the body 100, and may be in contact with and connected to each of the first lead-out pattern 331 and the first auxiliary lead-out pattern 341. The second external electrode 420 may be disposed on the sixth surface 106 of the body 100, and may be in contact with and connected to each of the second lead-out pattern 332 and the second auxiliary lead-out pattern 342. In this embodiment, since the external electrodes 410 and 420 and the auxiliary lead-out patterns 341 and 342 may be respectively in contact with and connected to each other, coupling reliability between each of the external electrodes 410 and 420 and the coil portion 300 may be improved. For example, the support substrate 200 may be disposed between the first lead-out pattern 331 and the first auxiliary lead-out pattern 341, to be exposed from the sixth surface 106 of the body 100. In this case, a recess may be formed in a region of the first external electrode 410 corresponding to the support substrate 200 exposed from the sixth surface 106 of the body 100 due to deviation in plating, but is not limited thereto.

The external electrodes 410 and 420 may electrically connect a coil component 1000 according to this embodiment to a printed circuit board or the like, when the coil component 1000 is mounted on the printed circuit board or the like. For example, the coil component 1000 according to this embodiment may be mounted such that the sixth surface 106 of the body 100 faces an upper surface of the printed circuit board, and the external electrodes 410 and 420, arranged on the sixth surface 106 of the body 100 to be spaced apart from each other, may be electrically connected to a connection portion of the printed circuit board.

The external electrodes 410 and 420 may be formed of a conductive material such as copper (Cu), aluminum (Al), silver (Ag), tin (Sn), gold (Au), nickel (Ni), lead (Pb), chromium (Cr), titanium (Ti), or alloys thereof, but are not limited thereto.

Each of the external electrodes 410 and 420 may be formed in a multilayer structure. For example, each of the external electrodes 410 and 420 may include first metal layers 411 and 421, disposed to contact the lead-out portions (i.e., 331, 332, 341 and 342), second metal layers 412 and 413 disposed on the first metal layer 411, and second metal layers 422 and 423 disposed on the first metal layer 421. The first metal layers 411 and 421 may be formed by vapor deposition such as sputtering or the like, or electroplating. When the first metal layers 411 and 421 are formed by electroplating, the first metal layers 411 and 421 may be extended to contact the sixth surface 106 of the body 100 due to a plating smearing phenomenon. In this case, bonding force between the external electrodes 410 and 420 and the body 100 may be improved. The second metal layers 412 and 413 may be formed on the first metal layer 411 and the second metal layers 422 and 423 may be formed on the first metal layer 421 by electroplating. The second metal layers 412 and 413 may be formed in a multilayer structure, and the second metal layers 422 and 423 may be formed in a multilayer structure. As a non-limiting example, first plating layers 412 and 422, and second plating layers 413 and 423 formed on the first plating layers 412 and 422 may be included. For example, the first metal layers 411 and 421 may include copper (Cu), the first plating layers 412 and 422 may include nickel (Ni), and the second plating layers 413 and 423 may include tin (Sn).

The cover insulating layer 500 may cover the other surface of the body 100, and may be disposed to extend to at least a portion of each of the plurality of wall surfaces of the body 100. For example, the cover insulating layer 500 may cover the fifth surface 105 of the body 100, and may be disposed to extend to at least a portion of each of the first to fourth surfaces 101, 102, 103, and 104 of the body 100 respectively connected to the fifth surface 105 of the body 100. In this embodiment, the cover insulating layer 500 may cover the entirety of each of the first to fourth surfaces 101, 102, 103, and 104 of the body 100. For example, the cover insulating layer 500 may cover, for example, the entirety of the first surface 101 of the body 100 in the thickness direction T. As a result, in this embodiment, the cover insulating layer 500 may not cover the sixth surface 106 of the body 100.

The cover insulating layer 500 may include a thermoplastic resin such as a polystyrene-based resin, a vinyl acetate-based resin, a polyester-based resin, a polyethylene-based resin, a polypropylene-based resin, a polyamide-based resin, a rubber-based resin, an acrylic-based resin, and the like, a thermosetting resin such as a phenol-based resin, an epoxy-based resin, a urethane-based resin, a melamine-based resin, an alkyd-based resin, and the like, or a photosensitive resin.

The cover insulating layer 500 may be formed, for example, by disposing the sixth surface 106 of the body 100 to contact a support member, and then spray coating an insulating material for forming the cover insulating layer 500 on the entire first to the first to fifth surfaces 101, 102, 103, 104, and 105 of the body 100, but the scope of the present disclosure is not limited thereto. As another example, the cover insulating layer 500 may be formed by disposing an insulating material on the first to fifth surfaces 101, 102, 103, 104, and 105 of the body 100 by vapor deposition such as chemical vapor deposition (CVD). According to the above-described methods, compared to a case in which an insulating layer is disposed on each of the first to fifth surfaces 101, 102, 103, 104, and 105 of the body 100, the cover insulating layer 500 may be formed on the first to fifth surfaces 101, 102, 103, 104, and 105 of the body 100, to reduce the number of processes.

The oxide insulating film 21 may be formed on surfaces of the metal magnetic powder particles 20 and 30 exposed from one surface of the body 100, and may include metal ions of the metal magnetic powder particles 20 and 30. For example, the oxide insulating film 21 may be formed on exposed surfaces of the metal magnetic powder particles 20 and 30 exposed from the sixth surface 106 of the body 100, and may include metal ions of the metal magnetic powder particles 20 and 30.

According to the above-mentioned method of forming the cover insulating layer 500, although the cover insulating layer 500 may be formed on the first to fifth surfaces 101, 102, 103, 104, and 105 of the body 100, the insulating layer 500 may not be formed on the sixth surface 106 of the body 100. Therefore, the metal magnetic powder particles 20 and 30 may be exposed from the sixth surface 106 of the body 100. As described above, an insulating coating layer may be formed on a surface of the metal magnetic powder particles 20 and 30. Due to a relatively thin thickness and relatively weak bonding strength of the insulating coating layer, after forming the cover insulating layer 500 on the body 100, in peeling the support member and the sixth surface 106 of the body 100, the insulating coating layer disposed on an exposed region of the metal magnetic powder particles 20 and 30 may be removed from a surface of the metal magnetic powder particles 20 and 30, to expose the metal magnetic powder particles 20 and 30, which may be conductive, externally.

In this embodiment, after forming the cover insulating layer 500, the oxide insulating film 21 may be formed on the sixth surface 106 of the body 100 to prevent the occurrence of an electrical short circuit between the first external electrode 410 and the second external electrode 420. For example, by separating the sixth surface 106 of the body 100 from the support member, and then performing acid treatment on the sixth surface 106 of the body 100, the oxide insulating film 21 may be formed on surfaces of the metal magnetic powder particles 20 and 30, which may be conductive, exposed from the sixth surface 106 of the body 100. In this case, since a solution for the acid treatment may selectively react with the exposed metal magnetic powder particles 20 and 30 to form an oxide insulating film 21, the oxide insulating film 21 may include metal ions of the exposed metal magnetic powder particles 20 and 30. The formation of the oxide insulating film 21 by the acid treatment on the sixth surface 106 of the body 100 may reduce the number of processes, compared to a case of forming a separate patterned insulating layer on the sixth surface 106 of the body 100. Since the cover insulating layer 500 is formed prior to the oxide insulating film 21, the oxide insulating film 21 may not be disposed in regions of the body covered by the cover insulating layer 500, without considering negligible penetration by the acid treatment solution into an interface between the body 100 and edge portions of the cover insulating layer 500. That is, since the cover insulating layer 500 is formed prior to the oxide insulating film 21, the oxide insulating film 21 may not be disposed between the cover insulating layer 500 and the body 100, without considering negligible penetration by the acid treatment solution into the interface between the body 100 and the edge portions of the cover insulating layer 500. In a case that the acid treatment solution penetrates into the interface between the body 100 and the edge portions of the cover insulating layer 500, the oxide insulating film 21 may additionally be disposed on a portion of the magnetic powder particles 20 and 30 exposed from the body but covered by the edge portions of the cover insulating layer 500. In one example, "the oxide insulating film 21 may not be disposed between the cover insulating layer 500 and the body 100" may indicate that the entirely of the oxide insulating film 21 may not be disposed between the cover insulating layer 500 and the body 100, or may indicate that a majority portion of the oxide insulating film 21 may not be disposed between the cover insulating layer 500 and the body 100 and a minor portion of the oxide insulating film 21 may be disposed between edges of the cover insulating layer 500 and the body 100, due to the penetration by the acid treatment solution.

Due to a relatively porous structure of a cured product of the insulating resin 10 of the body 100, the acid treatment solution may penetrate from the sixth surface 106 of the body 100 to a predetermined depth (h1). As a result, the oxide insulating film 21 may be formed on at least a portion of a surface of the metal magnetic powder particles 20 and 30, which is not exposed from the sixth surface 106 of the body 100, but disposed to a predetermined depth from the sixth surface 106 of the body 100 described above, as well as on at least a portion of a surface of the metal magnetic powder particles 20 and 30, exposed from the sixth surface 106 of the body 100. In this case, the predetermined depth from the sixth surface 106 of the body 100 may be defined as a depth of about 1.5 times a particle diameter of the first powder particle 20 described above.

Since a particle diameter of the first powder particle 20 is larger than a particle diameter of the second powder particle 30, the oxide insulating film 21 may be generally formed on a surface of the first powder particle 20. For example, the first powder particle 20 and the second powder particle 30 may be disposed at a predetermined depth from the sixth surface 106 of the body 100. The second powder particle 30 may be dissolved in an acid treatment solution during acid treatment due to a relatively small particle diameter. The second powder particle 30 may be dissolved in the acid treatment solution to form a void V in a region having a predetermined depth from the sixth surface 106 of the body 100. As a result, a void V corresponding to a volume of the second powder particle 30 may remain in the insulating resin 10 disposed at a predetermined depth from the sixth surface 106 of the body 100 described above. As described above, since the particle diameter of the second powder particle 30 refers to a particle diameter according to a particle diameter distribution, a volume of the second powder particle 30 refers to a volume distribution. Therefore, "a volume of the void V corresponds to a volume of the second powder particle 30" may refer that a volume distribution of the void V may be substantially the same as a volume distribution of the second powder particle 30.

The oxide insulating film 21 may be formed by reacting an acid with metal magnetic powder particles 20 and 30, in which at least a portion of its surface is exposed from the sixth surface 106 of the body 100, or disposed in a certain depth from the sixth surface 106 of the body 100. Therefore, the oxide insulating film 21 may be discontinuously formed on the sixth surface 106 of the body 100 as a reference. In addition, a concentration of oxygen ions in the oxide insulating film 21 may decrease toward a central portion of each of the metal magnetic powder particles 20 and 30 from a surface thereof. For example, since a time period in which the surface of each of the metal magnetic powder particles 20 and 30 is exposed to the acid treatment solution may be longer than a time period of the central portion thereof, the oxide insulating film 21 may have a different concentration of oxygen ions depending on a depth thereof. As a result, a crack CR may be formed on the oxide insulating film 21, due to an imbalance such as metal ions or the like according to a redox reaction. For the above-described reasons, the oxide insulating film 21 of the present disclosure may be distinguished from those by technologies of applying or coating a separate oxide film on the metal magnetic powder particles 20 and 30.

Since the oxide insulating film 21 includes metal ions and oxygen ions of the metal magnetic powder particles 20 and 30, excellent electrical insulation properties may be provided. Therefore, in plating the external electrodes 410 and 420 on each of the first and second lead-out portions (i.e., 331 and 341, and 332 and 342), a plating smearing phenomenon and the like may be prevented without forming a separate plating resist on the sixth surface 106 of the body 100.

As illustrated in FIG. 5, based on any one of the metal magnetic powder particles 20 and 30 disposed at a predetermined depth from the sixth surface 106 of the body 100, the oxide insulating film 21 may be formed on the entire surface of the metal magnetic powder particles 20 and 30, or may be formed on only one region of the surface of the metal magnetic powder particles 20 and 30.

The coil component 1000 according to this embodiment may further include an insulating film formed along surfaces of the support substrate 200 and the coil portion 300. The insulating film may be for insulating the coil portion 300 from the body 100, and may include a known insulating material such as parylene, but is not limited thereto. The insulating film may be formed by a vapor deposition method or the like, but is not limited thereto, and may also be formed by stacking an insulating film on both surfaces of the support substrate 200.

Second Embodiment

Figure 6:
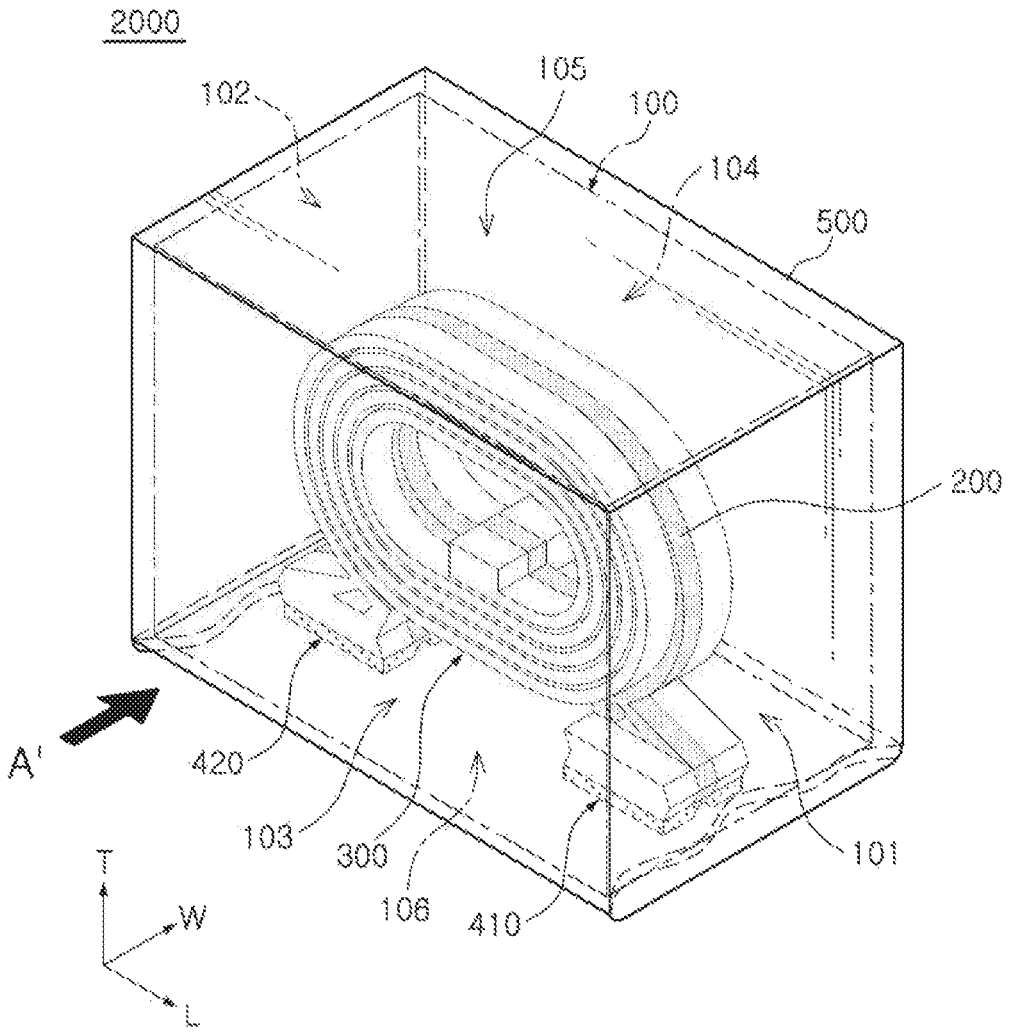
FIG. 6 is a view schematically illustrating a coil component according to a second embodiment of the present disclosure.
Figure 7:
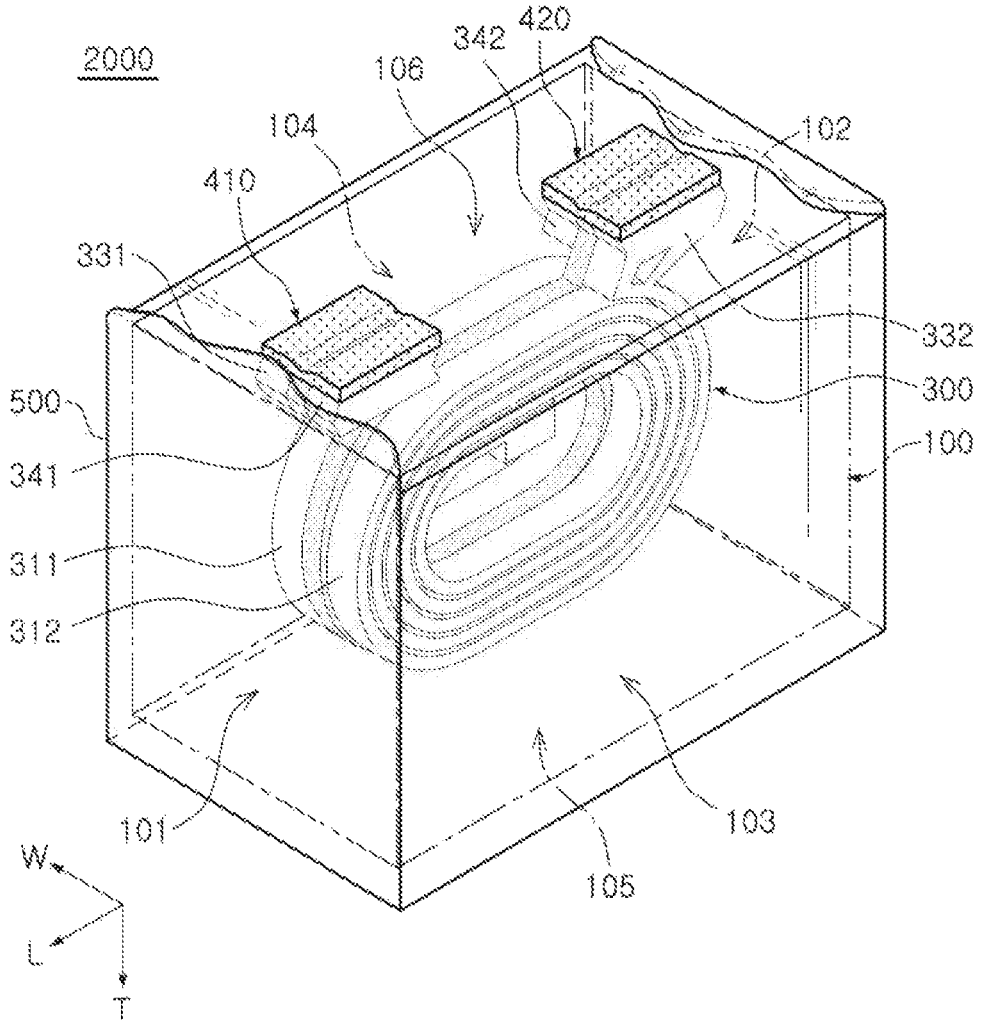
FIG. 7 is a view schematically illustrating a coil component according to a second embodiment of the present disclosure, when viewed from below.
Figure 8:
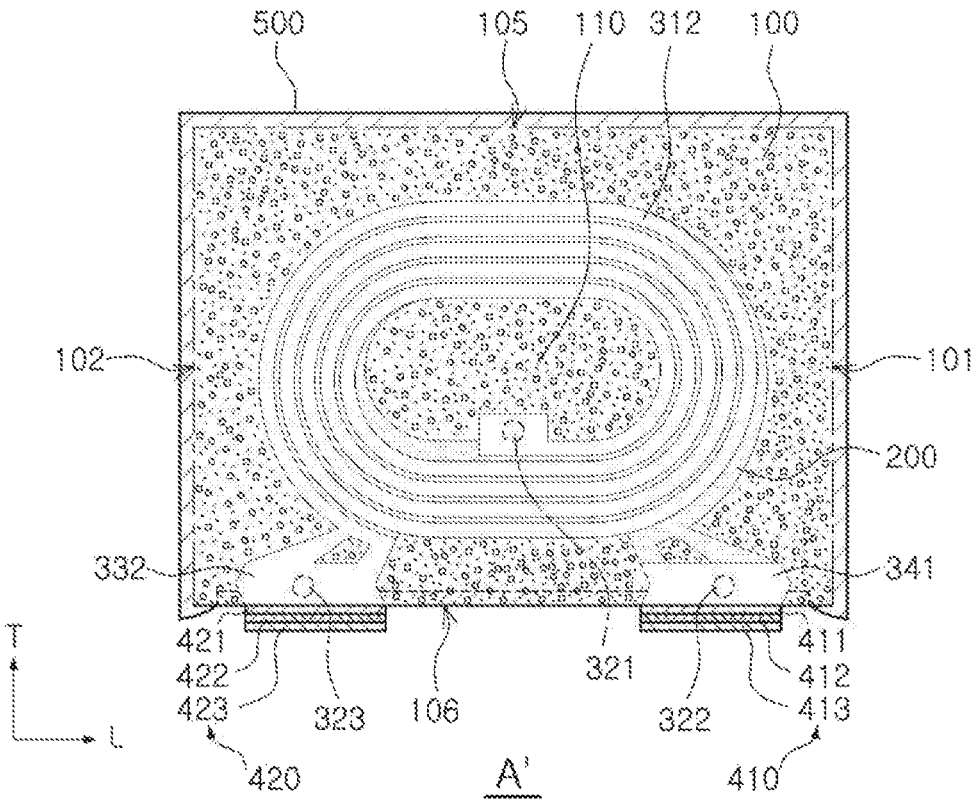
FIG. 8 is a schematic view of FIG. 6, when viewed in direction A'.

FIG. 6 is a view schematically illustrating a coil component according to a second embodiment of the present disclosure. FIG. 7 is a view schematically illustrating a coil component according to a second embodiment of the present disclosure, when viewed from below. FIG. 8 is a schematic view of FIG. 6, when viewed in direction A'.

Referring to FIGS. 1 to 5 and FIGS. 6 to 8, when a coil component 2000 according to this embodiment is compared to the coil component 1000 according to the first embodiment of the present disclosure, a cover insulating layer 500 and an oxide insulating film 21 may be differently provided. Therefore, in describing this embodiment, only the cover insulating layer 500 and the oxide insulating film 21, different from the first embodiment of the present disclosure, will be described. The remainder of the configuration of this embodiment may be applied as described in the first embodiment of the present disclosure.

Referring to FIGS. 6 to 8, at least a portion of the cover insulating layer 500, applied to this embodiment, may extend to one surface of the body. For example, at least a portion of the cover insulating layer 500 may extend to the sixth surface 106 of the body 100.

As described above, to form the cover insulating layer 500, the body 100 may be attached to the support member such that the sixth surface 106 of the body 100 comes into contact with the support member. Due to surface roughness of the sixth surface 106 of the body 100 and/or surface roughness of one surface of the support member contacting the sixth surface 106 of the body 100, a separation space may be formed between the sixth surface 106 of the body 100 and the one surface of the support member. In this case, when the cover insulating layer 500 is formed according to the above-described method, an insulating material for forming the cover insulating layer 500 may penetrate between the sixth surface 106 of the body 100 and the one surface of the support member. As a result, the cover insulating layer 500 may not only cover each of the first to fifth surfaces 101, 102, 103, 104, and 105 of the body 100, but also be extended to and disposed on at least a portion of the sixth surface 106 of the body 100.

As a result, among metal magnetic powder particles 20 and 30 having at least a portion of a surface exposed from the sixth surface 106 of the body 100, an oxide insulating film 21 may be formed on a surface of metal magnetic powder particles 20 and 30 having an exposed surface not covered with the cover insulating layer 500.

FIG. 7 illustrates that the cover insulating layer 500 may be disposed on opposite sides of the sixth surface 106 of the body 100 in the longitudinal direction, but this is only illustrative.

Third Embodiment

Figure 9:
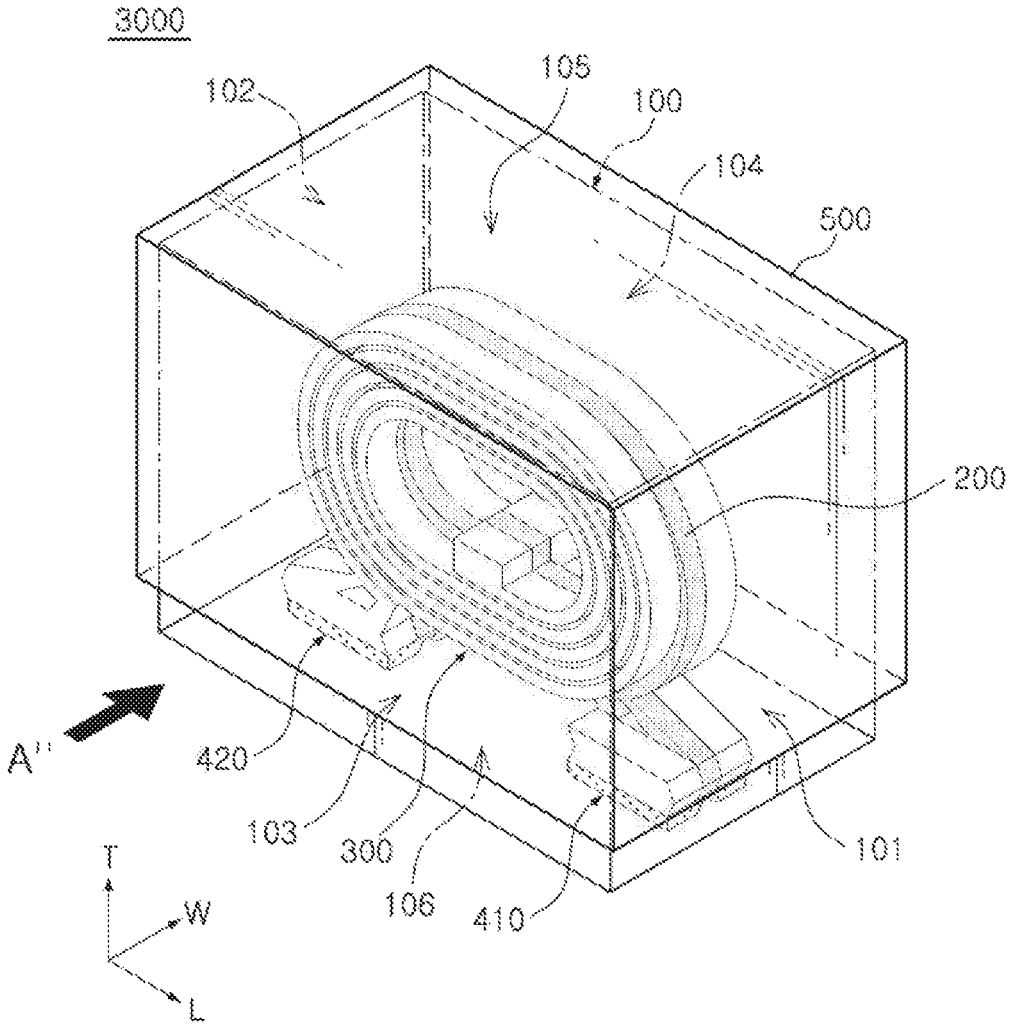
FIG. 9 is a view schematically illustrating a coil component according to a third embodiment of the present disclosure.
Figure 10:
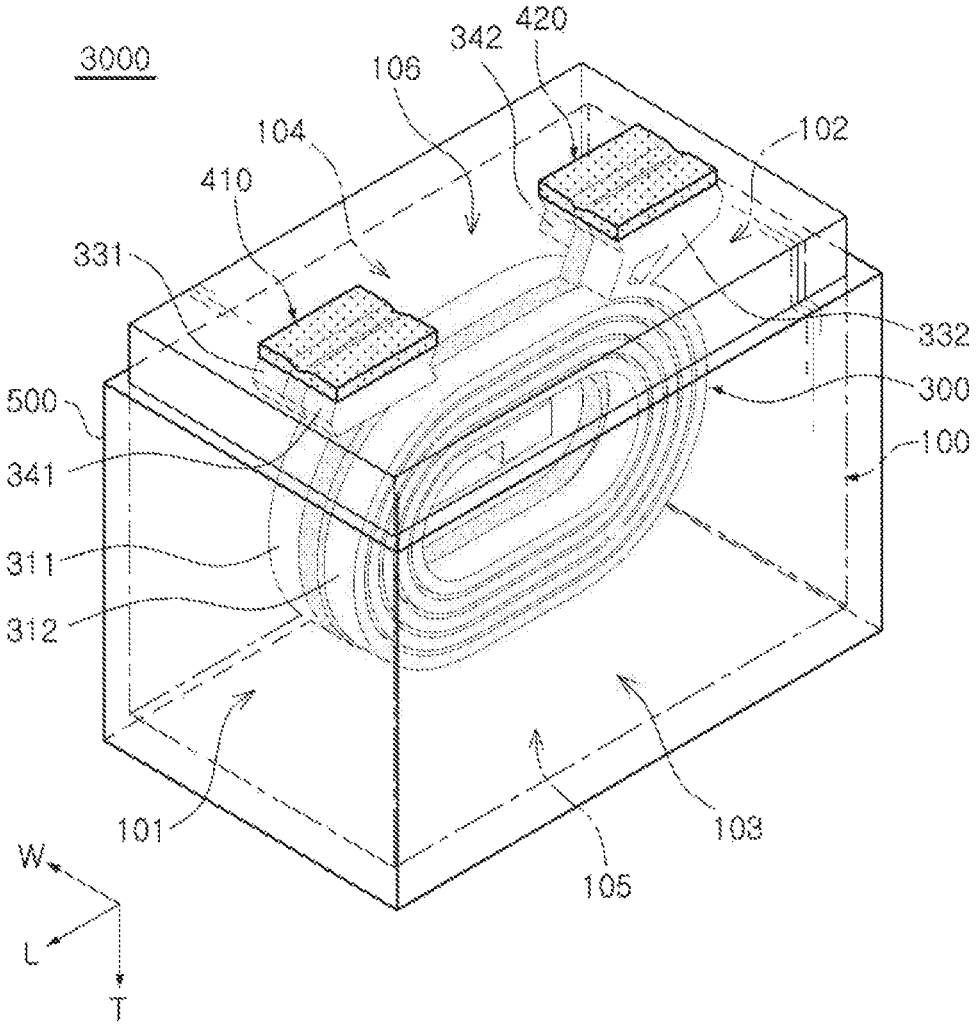
FIG. 10 is a view schematically illustrating a coil component according to a third embodiment of the present disclosure, when viewed from below.
Figure 11:
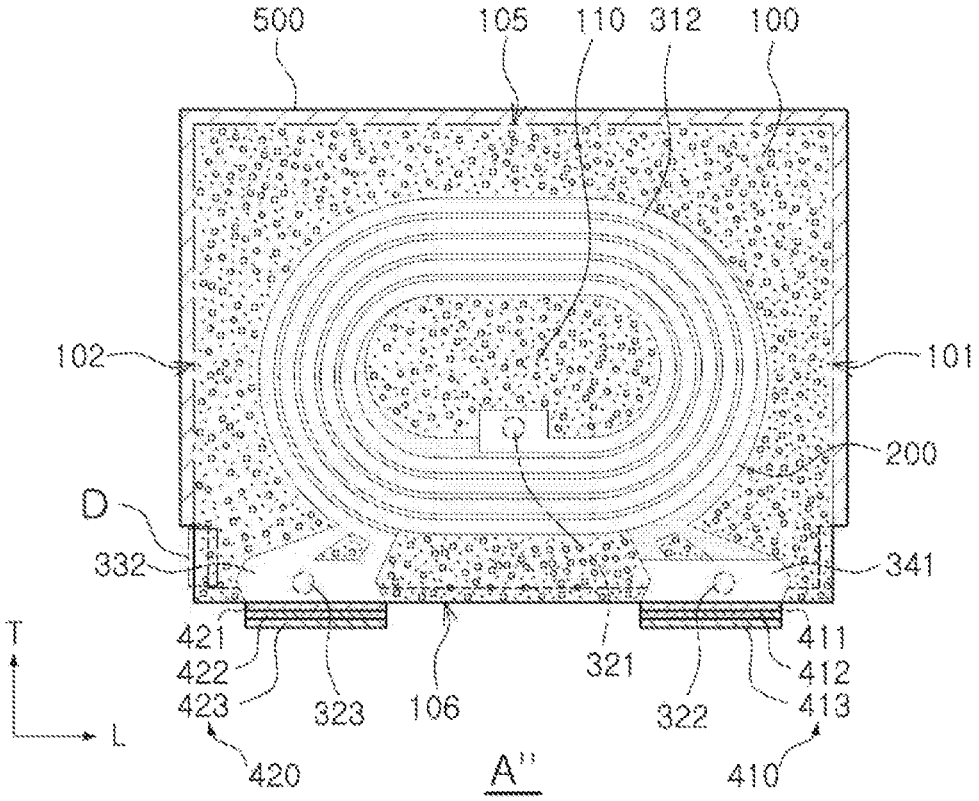
FIG. 11 is a schematic view of FIG. 9, when viewed in direction A".
Figure 12:
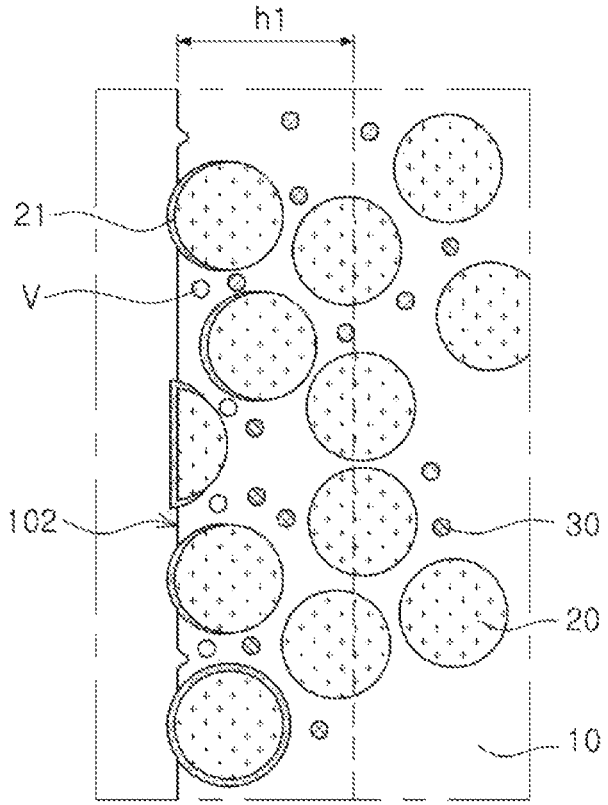
FIG. 12 is an enlarged view of portion D of FIG. 11.

FIG. 9 is a view schematically illustrating a coil component according to a third embodiment of the present disclosure. FIG. 10 is a view schematically illustrating a coil component according to a third embodiment of the present disclosure, when viewed from below. FIG. 11 is a schematic view of FIG. 9, when viewed in direction A". FIG. 12 is an enlarged view of portion D of FIG. 11.

Referring to FIGS. 1 to 5 and FIGS. 9 to 12, when a coil component 3000 according to this embodiment is compared to the coil component 1000 according to the first embodiment of the present disclosure, a cover insulating layer 500 and an oxide insulating film 21 may be differently provided. Therefore, in describing this embodiment, only the cover insulating layer 500 and the oxide insulating film 21, different from the first embodiment of the present disclosure, will be described. The remainder of the configuration of this embodiment may be applied as described in the first embodiment of the present disclosure.

Referring to FIGS. 9 to 12, the cover insulating layer 500 applied to this embodiment may be formed to expose at least a portion of each of the plurality of wall surfaces of the body 100. For example, the cover insulating layer 500 may cover the fifth surface 105 of the body 100 to extend to the first to fourth surfaces 101, 102, 103, and 104 of the body 100, but the body 100 may not entirely cover each of the first to fourth surfaces 101, 102, 103, and 104 in thickness direction T. As a result, end portions of the cover insulating layer 500 disposed on each of the first to fourth surfaces 101, 102, 103, and 104 of the body 100 may be spaced apart from the first to fourth surfaces 101, 102, 103, and 104 of the body 100, and from edges formed by the sixth surface 106 of the body 100 by a predetermined distance in the thickness direction T.

The above-described structure of this embodiment may be because that the support member used in the above-described process for forming the cover insulating layer 500 may be an elastic body such as an elastomer, not a rigid body, and, thus, in addition to the sixth surface 106 of the body 100, at least a portion of each of the first to fourth surfaces 101, 102, 103, and 104 of the body 100, connected to the sixth surface 106 of the body 100, may be in contact with the support member, due to the self-weight of the body 100, but may not be limited to.

In the case of this embodiment, due to the arrangement structure of the above-described cover insulating layer 500, the oxide insulating film 21 may not be covered by the cover insulating layer 500, and may be further formed on surfaces of the metal magnetic powder particles 20 and 30 exposed from a plurality of wall surfaces of the body 100, for example, each of the first to fourth surfaces 101, 102, 103, and 104 of the body 100.

The metal magnetic powder particles 20 and 30, exposed from each of the first to fourth surfaces 101, 102, 103, and 104 of the body 100, may have cut surfaces, unlike the metal magnetic powder particles 20 and 30, exposed from the sixth surface 106 of the body 100. The cut surfaces of the metal magnetic powder particles 20 and 30, exposed from each of the first to fourth surfaces 101, 102, 103, and 104 of the body 100, may be because a portion of the metal magnetic powder particles 20 and 30 may be cut off by the dicing blade due to the dicing process.

According to an embodiment of the present disclosure, an insulating structure may be easily formed on a surface of a body.

According to an embodiment of the present disclosure, a lower electrode structure may be easily formed.

According to the embodiment of the present disclosure, electrical short circuits between external electrodes may be prevented.

While example embodiments have been illustrated and described above, it will be apparent to those skilled in the art that modifications and variations could be made without departing from the scope of the present disclosure as defined by the appended claims.

What is claimed is:

1. A coil component comprising:

a body having one surface and the other surface, opposing each other, and a plurality of wall surfaces respectively connecting the one surface and the other surface, and including a metal magnetic powder particle and an insulating resin;

a coil portion disposed in the body and including first and second lead-out portions extending from the one surface of the body to be spaced apart from each other;

first and second external electrodes arranged on the one surface of the body to be spaced apart from each other and respectively connected to the first and second lead-out portions;

a cover insulating layer covering the other surface of the body and extending to at least portion of each of the plurality of wall surfaces of the body; and an oxide insulating film disposed on a surface of the metal magnetic powder particle exposed from the one surface of the body and including metal ions of the metal magnetic powder particle, wherein the oxide insulating film is spaced apart from the cover insulating layer, and the cover insulating layer and the oxide insulating film oppose each other in a direction perpendicular to a winding axis of coil portion.

2. The coil component according to claim 1, wherein the cover insulating layer covers an entirety of each of the plurality of wall surfaces of the body.

3. The coil component according to claim 2, wherein at least a portion of the cover insulating layer extends to the one surface of the body, and the oxide insulating film is disposed on a surface of the metal magnetic powder particle, not covered with the cover insulating layer and exposed from the one surface of the body.

4. The coil component according to claim 1, wherein the cover insulating layer exposes at least a portion of each of the plurality of wall surfaces of the body, and the oxide insulating film is further disposed on a surface of the metal magnetic powder particle, not covered with the cover insulating layer and exposed from each of the plurality of wall surfaces of the body.

5. The coil component according to claim 1, wherein a crack is disposed in the oxide insulating film.

6. The coil component according to claim 1, wherein a concentration of oxygen elements in the oxide insulating film decreases toward a central portion of the metal magnetic powder particle.

7. The coil component according to claim 1, wherein a void is disposed in the insulating resin.

8. The coil component according to claim 7, wherein the metal magnetic powder particle comprises a first powder particle and a second powder particle having a smaller particle diameter than the first powder particle, and a volume of the void corresponds to a volume of the second powder particle.

9. The coil component according to claim 1, wherein the oxide insulating film is discontinuously distributed on the one surface of the body.

10. The coil component according to claim 1, wherein each of the first and second external electrodes comprises a first metal layer disposed on the one surface of the body, and a second metal layer disposed on the first metal layer.

11. The coil component according to claim 1, wherein the oxide insulating film is exposed from the cover insulating layer.

12. The coil component according to claim 1, wherein the oxide insulating film is spaced apart from the other surface of the body.

* * * * *